US006051306A

United States Patent [19]

Paulson

[11] Patent Number: 6,051,306

[45] Date of Patent: Apr. 18, 2000

[54] INK JET PRINTABLE SURFACE

[75] Inventor: Bradley A. Paulson, Northfield, Minn.

[73] Assignee: Fargo Electronics, Inc., Eden Prairie, Minn.

[21] Appl. No.: 08/857,527

[22] Filed: May 16, 1997

Related U.S. Application Data

[63] Continuation-in-part of application No. 08/749,567, Nov. 15, 1996, abandoned.

[51] Int. Cl.[7] ..... B41M 5/00

[52] U.S. Cl. ..... 428/195; 347/105; 428/473.5; 428/478.2; 428/520; 428/522

[58] Field of Search ..... 428/195, 411.1, 428/500, 520, 473.5, 478.2, 522; 347/105

[56] References Cited

U.S. PATENT DOCUMENTS

| | | | |
|---|---|---|---|
| 4,474,850 | 10/1984 | Burwasser | 428/336 |
| 4,528,242 | 7/1985 | Burwasser | 428/413 |
| 4,555,437 | 11/1985 | Tanck | 428/212 |
| 4,575,465 | 3/1986 | Viola | 427/261 |
| 4,578,285 | 3/1986 | Viola | 427/209 |
| 4,592,954 | 6/1986 | Malhotra | 428/335 |
| 4,650,714 | 3/1987 | Kojima et al. | 428/341 |
| 4,680,235 | 7/1987 | Murakami et al. | 428/414.4 |
| 4,732,786 | 3/1988 | Patterson et al. | 427/161 |
| 4,758,461 | 7/1988 | Akiya et al. | 428/212 |
| 4,770,934 | 9/1988 | Yamasaki et al. | 428/331 |
| 4,830,911 | 5/1989 | Kojima et al. | 428/342 |
| 4,839,200 | 6/1989 | Hoffman et al. | 427/265 |
| 4,868,581 | 9/1989 | Mouri et al. | 346/1.1 |
| 4,877,678 | 10/1989 | Hasegawa et al. | 428/216 |
| 4,877,686 | 10/1989 | Riou et al. | 428/514 |
| 4,877,688 | 10/1989 | Senoo et al. | 428/522 |
| 4,900,620 | 2/1990 | Tokita et al. | 428/330 |
| 4,910,084 | 3/1990 | Yamasaki et al. | 428/411.1 |
| 4,926,190 | 5/1990 | Laver | 346/1.1 |
| 4,944,988 | 7/1990 | Yasuda et al. | 428/195 |
| 5,006,407 | 4/1991 | Malhotra | 428/336 |
| 5,041,328 | 8/1991 | Akiya et al. | 428/212 |
| 5,073,448 | 12/1991 | Vieira et al. | 428/331 |
| 5,084,340 | 1/1992 | Light | 428/327 |
| 5,096,781 | 3/1992 | Vieira et al. | 428/411.1 |
| 5,101,218 | 3/1992 | Sakaki et al. | 346/1.1 |
| 5,118,570 | 6/1992 | Malhotra | 428/474.4 |
| 5,120,601 | 6/1992 | Kotaki et al. | 428/327 |
| 5,124,201 | 6/1992 | Kurabayashi et al. | 428/323 |
| 5,126,193 | 6/1992 | Light | 428/327 |
| 5,126,194 | 6/1992 | Light | 428/327 |
| 5,137,778 | 8/1992 | Nakatsugawa et al. | 428/330 |
| 5,139,867 | 8/1992 | Light | 428/327 |
| 5,139,868 | 8/1992 | Mori et al. | 428/327 |
| 5,141,797 | 8/1992 | Wheeler et al. | 428/195 |
| 5,165,973 | 11/1992 | Kojima et al. | 428/331 |
| 5,171,626 | 12/1992 | Nagamine et al. | 428/212 |
| 5,180,624 | 1/1993 | Kojima et al. | 428/211 |
| 5,185,213 | 2/1993 | Fujita et al. | 428/500 |
| 5,190,805 | 3/1993 | Atherton et al. | 428/195 |
| 5,194,317 | 3/1993 | Sato et al. | 428/195 |
| 5,206,071 | 4/1993 | Atherton et al. | 428/195 |
| 5,208,092 | 5/1993 | Iqbal | 428/195 |
| 5,213,873 | 5/1993 | Yasuda et al. | 428/195 |
| 5,246,774 | 9/1993 | Sakaki et al. | 428/323 |
| 5,266,383 | 11/1993 | Sakaki et al. | 428/195 |
| 5,277,962 | 1/1994 | Nakatsugawa et al | 428/206 |
| 5,281,467 | 1/1994 | Shimada et al. | 428/195 |
| 5,302,436 | 4/1994 | Miller | 428/195 |
| 5,302,437 | 4/1994 | Idei et al. | 428/195 |
| 5,320,897 | 6/1994 | Kondo et al. | 428/195 |
| 5,328,748 | 7/1994 | Westfal | 428/195 |
| 5,338,597 | 8/1994 | Kurabayashi et al. | 428/195 |
| 5,352,503 | 10/1994 | Drake et al. | 428/195 |
| 5,362,558 | 11/1994 | Sakaki et al. | 428/323 |
| 5,364,702 | 11/1994 | Idei et al. | 428/423.1 |
| 5,372,884 | 12/1994 | Abe et al. | 428/331 |

*Primary Examiner*—Bruce H. Hess
*Attorney, Agent, or Firm*—Westman, Champlin & Kelly, P.A.

[57] ABSTRACT

An ink jet receiving surface includes a first hydrophilic polymer containing a hydroxyl group and a second hydrophilic polymer containing an amid, amine, imide, or imine group. A multicarboxylic acid or derivative thereof is provided which polymerizes the second hydrophilic polymer around the first hydrophilic polymer. Optionally pigment and binder are included in the surface.

17 Claims, No Drawings

INK JET PRINTABLE SURFACE

This is a continuation-in-part application of U.S. Ser. No. 08/749,567, filed on Nov. 15, 1996, now abandoned.

BACKGROUND OF THE INVENTION

The present invention relates to surfaces and coatings of surfaces useable in ink jet printing. More specifically, the present invention relates to a formulation for use in a coating, or a substrate suitable for receiving, ink jet printing.

Ink jet printers are known and provide a number of advantages in the printing process. For example, ink jet printers are capable of providing relatively high density color output at an acceptable printing speed. Further, such printers are relatively inexpensive. However, there are some surfaces on which it is difficult to print with an ink jet printer. For example, the ink from an ink jet printer typically does not adhere well to most polyester surfaces.

Fabricating receiving surfaces for ink jet ink is known in the art. Since ink jet ink is primarily aqueous, the receptive surface must be hydrophilic. Previous work indicates that acrylic resin, casein, cellulose, gelatin, gum arabic, maleic anhydride resin, melamine resin, polyaminoamide resins, poly acrylamide, polyacrylic acid, polyacrylate, polyalkylene glycol, polyethylene imine, polyethylene oxide, polysaccharides, polyvinyl alcohol, polyvinyl pyridine, polyvinyl pyrrolidone, sodium alginate, soy protein, starch, and urea resin, including derivatives and mixtures, can serve as the basis in obtaining an ink jet receptive material. (See, U.S. Pat. Nos. 4,474,850, 4,528,242, 4,555,437, 4,575,465, 4,578,285, 4,592,954, 4,650,714, 4,680,235, 4,732,786, 4,839,200, 4,877,678, 4,877,686, 4,877,688, 4,900,620, 4,944,988, 5,006,407, 5,084,340, 5,118,570, 5,120,601, 5,126,193, 5,126,194, 5,139,867, 5,139,868, 5,141,797, 5,180,624, 5,190,805, 5,206,071, 5,208,092, 5,213,873, 5,302,437, 5,328,748, 5,352,503, 5,364,702.)

As a consequence of being hydrophilic, the previously named compounds are generally water soluble. As such, significant work has been done to further polymerize or "cross-link" these compounds to increase their water resistance. For example, this has been done with polyfunctional aziridine (U.S. Pat. No. 5,208,092), boric acid (U.S. Pat. No. 4,877,686), carboxylate reactive cross-linkers (U.S. Pat. No. 4,732,786), plasticizers (U.S. Pat. Nos. 5,006,407 and 5,118,570), polyisocyanate, polyepichlorohydrin, or polymethylol (U.S. Pat. No. 5,139,868), polymeric high molecular weight quaternary ammonium salt (U.S. Pat. Nos. 4,830,911, 5,165,973 and 5,206,071), or titanium chelate (U.S. Pat. No. 5,141,797).

Additionally, the ink receptive material frequently contains a pigment or filler to aid in the absorbance and stability of the ink. These fillers are typically aluminum hydroxide, aluminum oxide, aluminum silicate, barium sulfate, calcium carbonate, calcium silicate, calcium sulfate, clay, diatomaceous earth, kaolin, magnesium carbonate, magnesium oxalate, magnesium silicate, polystyrene, silicon dioxide, talc, tin hydroxide, titanium dioxide, zeolites, and zirconium hydroxide. (See, U.S. Pat. Nos. 4,758,461, 4,770,934, 4,877,678, 4,877,686, 4,900,620, 5,041,328, 5,124,201, 5,137,778, 5,165,973, 5,171,626, 5,180,624, 5,185,231, 5,190,805, 5,194,317, 5,213,873, 5,246,774, 5,266,383, 5,277,962, 5,281,467, 5,302,437, 5,320,897, 5,338,597, 5,362,558 and 5,372,884.)

Ink stabilizers are also frequently added to enhance the stability of the printed image. (See, U.S. Pat. Nos. 4,419,388, 4,926,190 and 5,096,781.) Such additives include carboxylic acids (U.S. Pat. No. 5,302,436), hydroquinone derivatives (U.S. Pat. No. 5,073,448), and poly(dialkanol allylamine) derivatives or poly (dialkanol modified alkylene glycol) (U.S. Pat. No. 4,910,084).

SUMMARY OF THE INVENTION

The present invention provides an ink jet receiving surface which may optionally include pigment and binder. A first hydrophilic polymer is included which contains a hydroxyl group. A second hydrophilic polymer is included which contains an amide, amine, imide or imine group. A multicarboxylic acid or derivative thereof is provided which polymerizes the second hydrophilic polymer around the first hydrophilic polymer.

One aspect of the invention includes a coating to form the ink receiving surface. Another aspect of the invention includes forming a substrate as the ink receiving surface. Yet another aspect includes depositing a primer coating onto the substrate prior to depositing the ink receiving coating.

DETAILED DESCRIPTION OF THE PREFERRED EMBODIMENTS

The present invention provides a surface adapted for receiving ink from an ink jet printer. The surface may take the form of a coating which coats a substrate or a surface, or a substrate upon which ink jet ink may be directly printed. One aspect of the invention includes providing a surface that reduces bleeding of the image, reduces drying time of the ink, exhibits reduced smudging of the image and provides high durability to water of both the image and the coating.

According to one aspect of the present invention, a hydrophilic polymer is incorporated into coating formulations used to receive ink. The polymer is held immobile by polymerizing a second hydrophilic polymer around the first using a multicarboxylic acid. One aspect of the invention includes the combination of the two hydrophilic polymers to produce a surface which will provide a quality image and whereby the ink is water resistant, and the coating is water resistant.

Typically, coating formulations include a pigment and a binder. Emphasis in the prior art has been directed toward the use of non-flake pigments. A first set of hydrophilic polymers suitable to the present invention can be generally described as polymers having hydroxyl groups. Specific hydrophilic polymers for the first set include polysaccharides and polyalcohols. A second set of hydrophilic polymers suitable to the present invention can be generally described as polymers having amide, amine, imide, or imine groups. Specific hydrophilic polymers for the second set include water soluble proteins and polyethylene imine. A third component of the mixture can be generally described as a multicarboxylic acid or derivatives thereof, such as anhydrides or carboxyl halides. Specific carboxylic acids include dicarboxylic acids, such as, but not limited to, oxalic, malonic, succinic, glutaric, adipic, maleic, fumaric, phthalic, and polycarboxylic acids, such as polyacrylic acid. The third component causes the second hydrophilic polymers to polymerize around the first hydrophilic polymer thereby forming a water insoluble colloid.

In one preferred embodiment of the invention, a polyvinyl alcohol is dissolved in water. When the carboxylic acid or its derivative is a solid, it can be dissolved in water with the polyvinyl alcohol. After dissolution, the pigment can be added to the solution if desired. Finally, polyethylene imine is added to react with the carboxylic acid, forming a water insoluble colloid causing the polyethylene imine to hold the polyvinyl alcohol immobile.

When the carboxylic acid, or derivative, is liquid or in solution, another preferred embodiment of the invention is possible. In this embodiment, polyvinyl alcohol is dissolved with the polyethylene imine in water. After dissolution, a pigment can be added to the solution, if desired. Finally, the carboxylic acid, or derivative, is added to react with the polyethylene imine forming a water in soluble colloid.

In general, the use of a higher molecular weight polyvinyl alcohol enhances the water resistance of the printed image. Furthermore, increasing the amount of carboxylic acid functionality to the formulation increases the water durability of the coating. However, the use of excessive carboxylic acid functionality degrades the image resolution. Increasing the amount of polyethylene imine can also lead to degradation of the resolution.

In the above embodiments, the water insoluble colloid may be coated on polymeric substrates, such as acrylics or surfaces such as for CD-ROMs, CD recordables, identification card, etc. The inventive formulation is adaptable to a wide variety of substrate surfaces. The formulation adheres to the surface and is adapted for receiving ink from, for example, an ink jet printer. A pigment, such as a white pigment, may be added to the formulation to provide a desired background color. The coating is substantially water resistant and will remain bonded to the substrate. Further, the ink jet ink when deposited on a surface in accordance with the invention is also substantially water resistant.

As used herein, molecular equivalents are the functional or reactive sites in the molecule. Thus, for the polymeric (i.e., repeating units) described herein the equivalents would be the monomer or repeating units. Further, used herein, "normality" is defined as the equivalents per unit volume of solution. One embodiment of the present invention uses the following chemicals:

TABLE 1

| Chemical | Molecular Formula | Equivalent Weight |
|---|---|---|
| poly vinyl alcohol | $(CH_2CHOH)_n$ | 44.053 |
| poly(ethylene imine) | $(CH_2CH_2NH)_n$ | 43.069 |
| polyacrylic acid | $(CH_2CHCOOH)_n$ | 72.063 |

The present invention includes a formulation made in accordance with the following formula:

TABLE 2

| Chemical | Range (Equivalent %) | Formula (Equivalent %) |
|---|---|---|
| polyvinyl alcohol | 0 to 100 | 60 to 75 |
| poly(ethylene imine) | 0 to 30 | 20 to 30 |
| polyacrylic acid | 0 to 10 | 5 |

In the present invention, a coating of polyvinyl alcohol, polyethylene imine and polyacrylic acid are combined whereby each acrylic acid monomer will react with an amine in the polyethylene imine. Pigment is added to the formula to make the coating opaque and to absorb the ink jet solvent. In one embodiment, aluminum hydroxide pigment with a one micron diameter is provided. However, the present invention can function without a pigment if desired. In one embodiment of the present invention in which polyvinyl alcohol is 70 eq %, polyethylene amine is 25 eq % and polyacrylic acid is 5 eq %, the upper limitation on pigmentation on a weight basis relative to polyvinyl alcohol is 6:1. If a greater amount of pigmentation is added, the amount of solids in the formula is increased making application difficult.

In accordance with the present invention, the window of acceptable compositions is relatively wide. The limits are largely determined by the application process. For many applications, a fluid is preferred. However, the material may be fabricated as a solid substrate rather than a coating for a substrate. With respect to processing a liquid coating, there are two competing characteristics: higher molecular weight polymers have higher water resistive properties (i.e., they are harder to dissolve in water) while also having higher viscosities. It is the higher degree of polymerization that produces water resistance in the coating. However, the associated higher viscosity reduces the amount of polymer in solution (i.e., the normality of the solution is reduced). In the present invention, these two properties must be considered when determining the appropriate method of application. In one preferred embodiment of the invention the coating is applied by applying the solution to a substrate rotating at high speed which causes the solution to cover the surface of the substrate. This provides improved control of the application relative to spray coating or dipping the substrate. Further, screen printing provides the most control over the process and the final product. Therefore, in one embodiment, the present invention provides properties which are adapted for screen printing. In one preferred embodiment, the formulation is as follows for a quart of liquid:

TABLE 3

| Chemical | | Amount | Concentration (Normality) |
|---|---|---|---|
| polyvinyl alcohol | powder | 31.65 g | 0.0020 |
| poly(ethylene imine) | 50% solution | 44 mL | 0.00072 |
| polyacrylic acid | 25% solution | 30 mL | 0.00015 |
| aluminum hydroxide | powder | 379.85 g | 0.0069 |
| water | | 648 mL | |
| hydrochloric acid | 37% solution | 16.5 mL | |

The above formulation produces a liquid that is approximately 40% solid which is well suited for screen printing. The higher molecular weight polyvinyl alcohol improves the water resistance of the coating, but increases the viscosity of the liquid, which therefore requires a more dilute formula. In one preferred embodiment, the molecular weight is between 87,000 and 89,000. However, in another embodiment, the molecular weight of the polyvinyl alcohol may be increased to 120,000. Furthermore, since aluminum hydroxide is alkaline, the hydrochloric acid is added to neutralize the coating. However, a slight acidity is preferred for optimum ink performance. Use of an acidic pigment can eliminate the need for this pH adjustment.

The solution of Table 3 is formed by adding the polyvinyl alcohol and the poly(ethylene imine) to water. This is heated to a sufficient temperature for a sufficient duration to dissolve the polyvinyl alcohol. After the solution, the liquid is allowed to cool to ambient temperature. The aluminum hydroxide pigment is added to the liquid and the liquid is vigorously mixed to disperse the pigment. Under continued mixing, the polyacrylic acid is added. Hydrochloric acid is then added to lower the pH to less than 7.

In another aspect of the present invention, a primer coating is first deposited upon the substrate prior to depositing the ink receiving surface. Such a primer coating preferably adheres to the substrate and exposes a hydrophilic surface for receiving the ink receiving surface. The primer coating allows the ink receiving surface of the present invention to be used with substantially any type of substrate. For example, the substrate may be of a type to which the ink receiving surface poorly adheres, i.e., a hydropholic surface. One preferred primer coating is what is known in the art as a "signature panel ink" which are used, for example, to receive ink from a pen and are frequently used on the back of credit cards. One such signature panel ink is 20750 Sp PF Signature White which is available from Sericol, Inc., 1101 West Cambridge Drive, P.O. Box 2914, Kansas City, Kans. This particular primer coating is deposited through silk screening followed by an ultraviolet curing step. With Sp PF Signature White primer coat, ultraviolet radiation at 300 watts/inch was found sufficient for coating the surface of a CD recordable and 200 watts/inch was found suitable for coating the surface of a PVC card, such as an identification card. In both instances, the surfaces were moving at a speed of 20 feet per minute along a conveyor belt.

One aspect of the invention includes a method of ink jet printing with an aqueous ink jet ink onto a hydropholic surface. In the method, a substrate having the hydropholic surface is obtained. An ink receiving mixture is made by mixing a first hydrophilic polymer which contains a hydroxyl group with a second hydrophilic polymer selected from the group of hydrophilic polymers having amid, amine, imide and imine groups with multicarboxylic acid or a derivative thereof which polymerizes the second hydrophilic polymer around the first hydrophilic polymer. The coated substrate is next placed into an ink jet printer and an aqueous ink is deposited onto the coated surface using the ink jet printer. In another aspect of the method, a primer coating is deposited onto the substrate prior to depositing the ink receiving surface.

Although the present invention has been described with reference to preferred embodiments, workers skilled in the art will recognize that changes may be made in form and detail without departing from the spirit and scope of the invention. Additionally the invention may be modified such that a substrate is formed directly from a suitable formulation. Thus, the substrate can be printed on with an ink jet printer and a coating is not required.

What is claimed is:

1. A method of printing onto a substrate using an aqueous ink from an ink jet printer, comprising:

obtaining a substrate having a non-hydrophilic surface;

coating the non-hydrophilic surface of the substrate with an ink receiving surface mixture which includes a first hydrophilic polymer containing a hydroxyl group, a second hydrophilic polymer selected from the group of hydrophilic polymers having amid, amine, imide and imine groups, and a multicarboxylic acid, or an anhydride derivative thereof, or a carboxyl halide derivative thereof, which polymerizes the second hydrophilic polymer around the first hydrophilic polymer thereby forming a water insoluble colloid;

placing the coated substrate into an ink jet printer; and printing an image on to the coated surface using the ink jet printer by depositing an aqueous ink jet ink onto the coated surface of the substrate.

2. The method of claim 1 including coating the substrate surface with a primer coat prior to coating the non-hydrophilic surface of the substrate with the ink receiving surface.

3. The method of claim 2 including curing the primer coat following depositing the primer coat upon the non-hydrophilic surface of the substrate.

4. The method of claim 2 wherein the primer coat comprises a signature panel ink.

5. The method of claim 1 wherein the step of obtaining a substrate comprises obtaining a CD recordable disk.

6. The method of claim 1 wherein the step of obtaining a substrate comprises obtaining an identification card.

7. The method of claim 1 wherein the ink receiving surface includes between 0 and 95 parts by weight pigment.

8. An ink jet receiving medium, comprising:

(a) a substrate and (b) an ink receiving layer comprising between 0 and 95 parts by weight pigment;

a first hydrophilic polymer containing a hydroxyl group;

a second hydrophilic polymer selected from the group of hydrophilic polymers having amide, amine, imide and imine groups; and a multicarboxylic acid or an anhydride derivative thereof, or a carboxyl halide derivative thereof which polymerizes the second hydrophilic polymer around the first hydrophilic polymer.

9. The ink jet receiving surface of claim 8 wherein the hydroxyl group of the first hydrophilic polymer comprises polysaccharide.

10. The ink jet receiving surface of claim 8 wherein the hydroxyl group of the first hydrophilic polymer comprises polyalcohols.

11. The ink jet receiving surface of claim 8 wherein the second hydrophilic polymer comprises a water soluble protein.

12. The ink jet receiving surface of claim 8 wherein the second hydrophilic polymer comprises polyethylene imine.

13. The ink jet receiving surface of claim 8 wherein the multicarboxylic acid or derivative thereof comprises dicarboxylic acid.

14. The ink jet receiving surface of claim 13 wherein the dicarboxylic acid is selected from the group consisting of oxalic, malonic, succinic, glutaric, adipic, maleic, fumaric, phthalic, and polycarboxylic acid.

15. The ink jet receiving surface of claim 8 wherein the multicarboxylic acid comprises polyacrylic acid.

16. The ink jet receiving surface of claim 8 wherein the receiving layer is coated onto an acrylic substrate.

17. The ink jet receiving surface of claim 16 wherein the substrate comprises a disc.

* * * * *

UNITED STATES PATENT AND TRADEMARK OFFICE

CERTIFICATE OF CORRECTION

PATENT NO. : 6,051,306
DATED : April 18, 2000
INVENTOR(S) : Bradley A. Paulson

It is certified that error appears in the above-identified patent and that said Letters Patent is hereby corrected as shown below:

Column 6,
Line 28, cancel "derivative thereof".

Signed and Sealed this

Fourth Day of September, 2001

*Attest:*

Nicholas P. Godici

NICHOLAS P. GODICI
*Acting Director of the United States Patent and Trademark Office*

*Attesting Officer*